US005283989A

United States Patent [19]

Hisasue et al.

[11] Patent Number: 5,283,989

[45] Date of Patent: Feb. 8, 1994

[54] APPARATUS FOR POLISHING AN ARTICLE WITH FROZEN PARTICLES

[75] Inventors: Akiko Hisasue; Itaru Kanno; Takaaki Fukumoto, all of Itami, Japan

[73] Assignee: Mitsubishi Denki Kabushiki Kaisha, Tokyo, Japan

[21] Appl. No.: 577,536

[22] Filed: Sep. 5, 1990

[30] Foreign Application Priority Data

May 30, 1990 [JP] Japan ..... 2-138277

[51] Int. Cl.[5] ..... B24R 7/00

[52] U.S. Cl. ..... 51/410; 51/322; 51/436

[58] Field of Search ..... 51/415, 322, 320, 319, 51/436

[56] References Cited

U.S. PATENT DOCUMENTS

| | | | |
|---|---|---|---|
| 4,748,817 | 6/1988 | Oura et al. | 62/74 |
| 4,932,168 | 6/1990 | Tada et al. | 51/436 |
| 4,962,891 | 10/1990 | Layden | 51/320 |
| 5,025,597 | 6/1991 | Tada et al. | 51/436 |

FOREIGN PATENT DOCUMENTS

| | | | |
|---|---|---|---|
| 3729992 | 2/1990 | Fed. Rep. of Germany . | |
| 0156661 | 6/1988 | Japan | 51/415 |
| 1-292832 | 11/1989 | Japan | 51/322 |

*Primary Examiner*—Robert A. Rose
*Attorney, Agent, or Firm*—Leydig, Voit & Mayer

[57] ABSTRACT

A novel and improved polishing apparatus is disclosed which employs ice particles as an abrasive material, the hardness of which can be changed so as to match that of an article being polished for performing polishing operation in a most efficient manner without impairing or marring the polished surface of the article. To this end, the polishing apparatus includes a freezing vessel defining therein an ice particle producing chamber, a coolant supply nozzle mounted on the freezing vessel and connected with a coolant source through a coolant supply line for spraying a coolant into the ice particle producing chamber to form a freezing atmosphere, a liquid supply nozzle mounted on the freezing vessel and connected with a liquid supply for spraying a liquid into the ice particle producing chamber so that the liquid thus sprayed is cooled and freezed by the freezing atmosphere to produce superfine ice particles, a particle hardness adjuster for adjusting the hardness of the ice particles to be produced so as to match the hardness of an article being polished, and an injection nozzle for injecting the ice particles towards a surface of the article for polishing thereof. Preferably, the particle hardness adjuster comprises a flow control valve which is disposed on the coolant supply line between the coolant supply nozzle and the coolant source for adjusting and changing the amount of coolant sprayed therefrom into the ice particle producing chamber so as to control the temperature therein.

3 Claims, 2 Drawing Sheets

APPARATUS FOR POLISHING AN ARTICLE WITH FROZEN PARTICLES

BACKGROUND OF THE INVENTION

The present invention relates to a polishing apparatus using ice particles which is suitable for polishing a surface of an article having a relatively low hardness such as a compound semiconductor, a crystalline block, etc.

FIG. 3 shows a typical example of conventional polishing apparatus for such purposes. In this conventional polishing apparatus, a major or large-diameter rotary plate 102 is rotatably mounted on a fixed support member 101, and a plurality (3 in the illustrated example) of minor or small-diameter rotary disks 103 are rotatably mounted on the major rotary plate 102. On each of the rotary disks 103, a plurality of articles 104 to be polished such as semiconductor wafers are disposed substantially in a circumferentially spaced apart relation and fixed thereto through appropriate fixing means (not shown) such as vacuum chucks and the like.

In operation, a top plate (not shown) is first disposed on the top surfaces of the articles to be polished with some kind of fine abrasive particles such as $Al_2O_3$, $SiO_2$, etc. being interposed therebetween. Then the major rotary plate 102 and the minor rotary disks 103 are rotated with respect each other and with respect to the fixed support plate 101 under the action of a certain drive means (not shown) while supplying thereto purified water as a lubricant.

With the conventional polishing apparatus as constructed above, however, if the hardness of the articles to be polished is relatively low as compared with that of the abrasive particles employed, there will be a problem that the surfaces of the articles being polished are damaged, impaired or marred due to the excessive abrasive action of the abrasive particles. In order to avoid such a problem, it is necessary to carefully choose an appropriate kind of abrasive which has hardness matching that of the articles being polished. The selection of such an abrasive suited to the hardness of the articles being polished is generally a troublesome task, and it is often difficult to find an appropriate abrasive.

SUMMARY OF THE INVENTION

Accordingly, the present invention is intended to obviate the above-described problem of the prior art, and has for its object the provision of a novel and improved polishing apparatus which employs ice particles as an abrasive and which is able to perform a polishing operation in a most efficient manner without impairing or marring the surfaces of articles being polished.

Another object of the present invention is to provide a polishing apparatus of the type described in which the hardness of the ice particles employed is able to be varied in a very easy and simple manner so as to substantially match the hardness of articles being polished.

In order to achieve the above objects, according to the present invention, there is provided a polishing apparatus comprising:

ice particle producing means for producing superfine ice particles;

particle hardness adjusting means for adjusting the hardness of the ice particles produced by the ice particle producing means; and means for ejection the ice particles towards a surface of the article for polishing thereof.

In one embodiment, the ice particle producing means comprises:

a freezing vessel including an ice particle producing chamber;

a coolant supply nozzle mounted on the freezing vessel for spraying a coolant into the ice particle producing chamber to form a freezing atmosphere;

a liquid supply nozzle mounted on the freezing vessel for spraying a liquid into the ice particle producing chamber so that the liquid thus sprayed is cooled and frozen by the freezing atmosphere to produce superfine ice particles; and an ice particle supply pipe connected with the freezing vessel and the injection means for supplying the ice particles from the freezing vessel to the injection means.

Preferably, the particle hardness adjusting means comprises a flow control valve which is disposed on the coolant supply line between the coolant supply nozzle and the coolant source for adjusting and changing the amount of coolant sprayed therefrom into the ice particle producing chamber so as to control the temperature therein.

The above and other objects, features and advantages of the present invention will become more readily apparent form the following detailed description of a preferred embodiment of the invention taken in conjunction with the accompanying drawings.

DESCRIPTION OF THE PREFERRED EMBODIMENT

The present invention will now be described in detail with reference to a preferred embodiment thereof as illustrated in the accompanying drawings.

Figure 1:
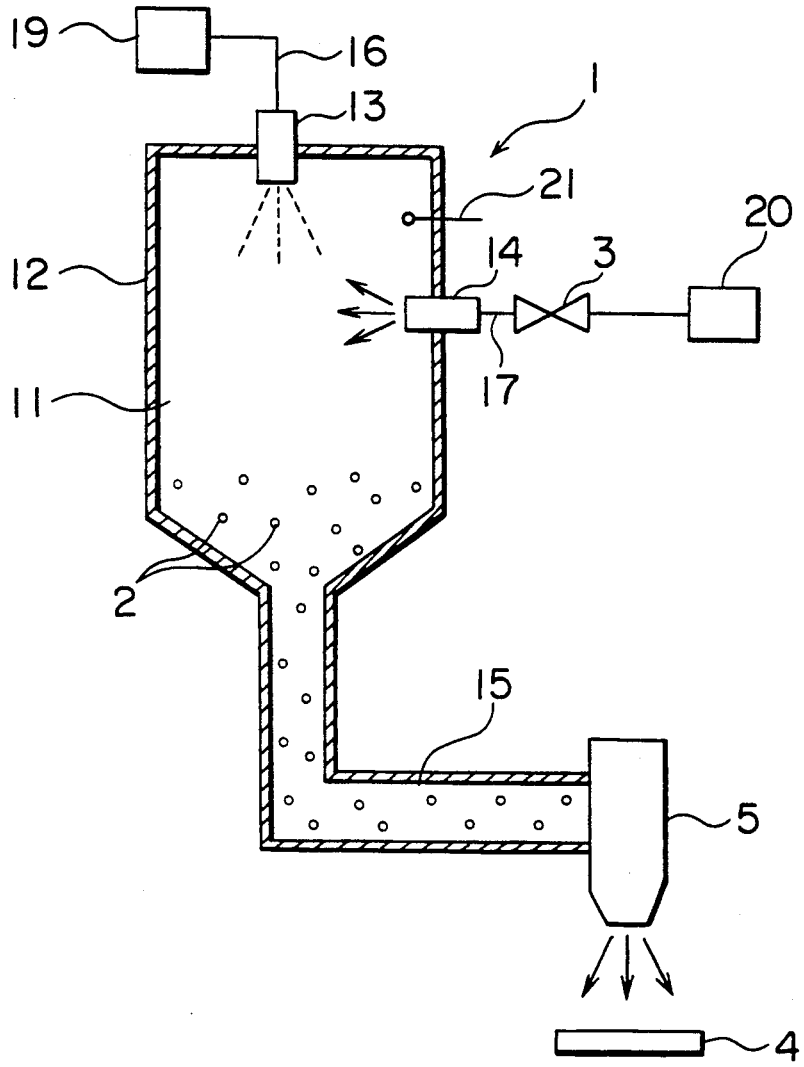
FIG. 1 is a schematic view of the general construction of a polishing apparatus using ice particles in accordance with the present invention.

Referring first to FIG. 1, a polishing apparatus as schematically illustrated includes ice particle producing means 1 for producing superfine ice particles 2, particle-hardness adjusting means 3 for adjusting the hardness of the ice particles 2 produced by the ice particle producing means 3 to match the hardness of a relatively soft article 4 in the form of a semiconductor wafer and the like being polished, and means 5 in the form of an ejection nozzle for injecting the ice particles 2 towards a surface of the article 4 for polishing thereof.

The ice particle producing means 1 comprises a freezing vessel 12 of generally cylindrical form containing an ice particle producing chamber 11 and having a conical bottom portion, a liquid supply nozzle 13 disposed on the top of the freezing vessel 12 and having a tip end presented into the ice particle producing chamber 11, a coolant supply nozzle 14 disposed on the cylindrical side wall of the freezing vessel 12 and having a tip end pointed into the ice particle producing chamber 11, and an ice particle supply pipe 15 having one end connected to the tapered end of the conical bottom portion of the freezing vessel 12 and the other end connected to the injection nozzle 5.

The liquid supply nozzle 13 is connected through a liquid supply line 16 with a liquid source 19 storing therein a liquid such as a superpure water to the frozen for spraying the liquid into the ice particle producing chamber 11 in a finely atomized manner.

The coolant supply nozzle 14 is connected through a coolant supply line 17 with a coolant source 20 storing a coolant such as a liquefied nitrogen for spraying the coolant into the ice particle producing chamber 11 so as to cool the interior thereof.

The particle hardness adjusting means 3 is, in the illustrated embodiment, in the form of a flow control valve which is disposed on the coolant supply line 17 between the coolant supply nozzle 14 and the coolant source 20 for adjusting and changing the amount of coolant sprayed therefrom into the ice particle producing chamber 11 so as to control the temperature therein. In this case, however, the temperature at which the liquid in the ice particle producing chamber is frozen can also be controlled by changing the temperature of the coolant itself to be supplied thereto from the coolant source 20 through the coolant supply line 17 and the nozzle 14.

A temperature sensor 21 in the form of a thermometer is mounted on the cylindrical side wall of the freezing vessel 12 for sensing the temperature inside the ice particle producing chamber 11.

Next, the operation of this embodiment will be described.

First, an article 4 in the form of a semiconductor wafer to be polished is disposed just below the injection nozzle 5, and the flow control valve 3 is then opened so that the coolant in the form of liquefied nitrogen is introduced from the coolant source 20 to the coolant supply nozzle 14 though the coolant supply line 17, and thence sprayed into the interior of the ice particle producing chamber 11, thus generating therein a freezing atmosphere. In this case, based on a reading of the temperature in the ice particle producing chamber 11 as sensed by the thermometer 21, the amount of coolant supplied to the chamber 11 can be properly controlled by the flow control valve 3 so that the temperature of the freezing atmosphere in the chamber 11 is set to a prescribed value which is suitable for providing ice particles of a hardness matching that of the article 4 being polished.

Thereafter, the liquid such as superpure water to be frozen is sprayed into the freezing atmosphere in the ice particle producing chamber 11 through the liquid supply nozzle 13 in a finely atomized form or superfine droplets, so that the atomized superfine droplets of the liquid thus sprayed are swiftly cooled and frozen to provide a multitude of superfine ice particles 2 which come down and are collected in the conically shaped bottom portion of the cylindrical freezing vessel 12. In this regard, the diameter of each ice particle produced is generally on the order of around 0.1 to 10 $\mu$m.

The ice particles thus collected are fed to the ejection nozzle 5 through the ice particle supply pipe 15 so that they are ejected as an abrasive material from the tip of the ejection nozzle 5 onto a surface of the article 4, which is disposed just below the nozzle 5, for the polishing thereof.

Here, it is to be noted that if the abrasive material in the form of the ice particles 2 is too hard with respect to the article 4 being polished, the surface of the article 4 can be damaged or impaired, and on the other hand, if it is too soft, no satisfactory polishing effect will be obtainable. So, it is necessary to make the hardness of the ice particles 2 equal or as close to that of the article 4 as possible.

Figure 2:
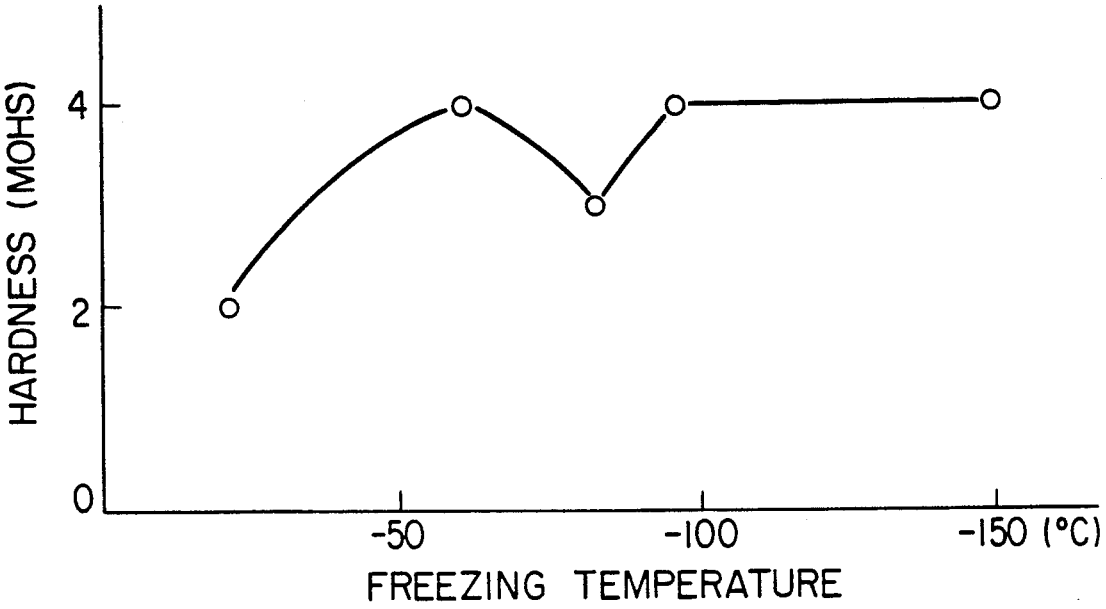
FIG. 2 is a graph showing the relation between the freezing temperature and the hardness of ice particles as produced by the polishing apparatus of FIG. 1.
Figure 3:
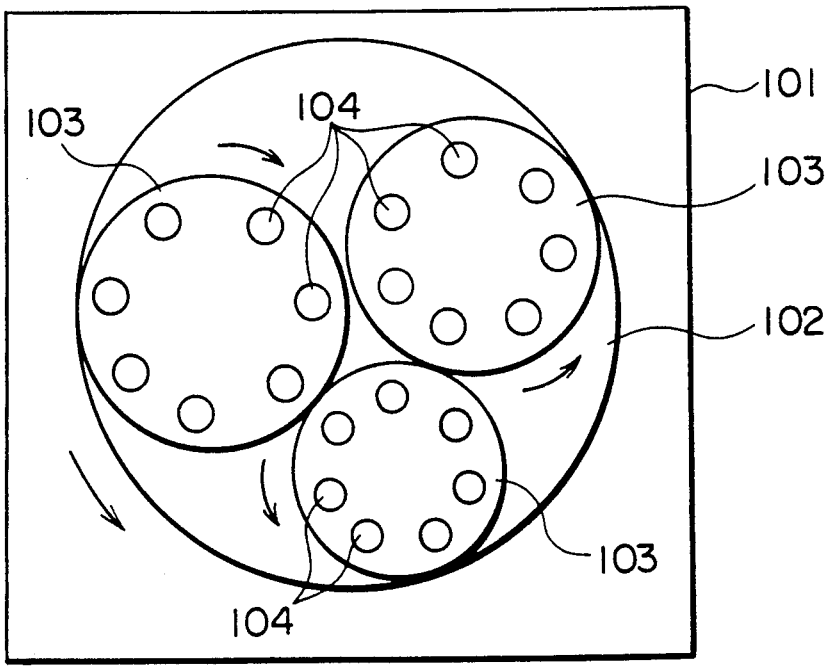
FIG. 3 is a schematic view showing major portions of a conventional polishing apparatus.

As shown in FIG. 2, the hardness of the ice particles 2 as an abrasive material can, for example, be changed from grade 2 to 4 in mohs hardness as the temperature of the freezing atmosphere in the ice particle producing chamber 11 varies from −20° C. to 150° C. Also, instead of or in addition to changing the temperature of the freezing atmosphere in the ice particle producing chamber 11, the hardness of the ice particles 2 can be adjusted by changing the injection speed of a liquid being frozen which is sprayed form the liquid supply nozzle 13 into the ice particle producing chamber 11.

In addition, some examples of materials (or elements), which can be polished by the polishing apparatus of the present invention, are listed below.

| Names of Elements | Mohs Hardness |
|---|---|
| Pb | 1.5 |
| Ga | 1.5~2.5 |
| Zn | 2.5 |
| Mg | 2.6 |
| Au | 2.5~3 |
| Al | 3 |
| Cu | 3 |
| Ni | 3.8 |
| Ti | 4.0 |

As described in the foregoing, according to the present invention, a particle hardness adjusting means is provided for variably adjusting the hardness of superfine ice particles which are produced by an ice particle producing means. With this particle hardness adjusting means, the hardness of the ice particles can be readily adjusted so as to match the hardness of an article being polished in a very simple and easy manner. Thus, using, as an abrasive material, the ice particles having a proper hardness suited to the article being polished, it is possible to efficiently polish without damaging or impairing the polished surface of the article.

What is claimed is:

1. A polishing apparatus comprising:

frozen particle producing means for producing superfine frozen particles including a freezing vessel containing a frozen particle producing chamber, a coolant supply nozzle mounted on the freezing vessel for spraying a coolant into the frozen particle producing chamber to form a freezing atmosphere in the chamber, and a liquid supply nozzle mounted on the freezing vessel spaced from the coolant supply nozzle for spraying a liquid into the frozen particle producing chamber so that the liquid thus sprayed mixes with, is cooled by, and is frozen by the coolant to produce superfine frozen particles;

particle hardness adjusting means for adjusting the hardness of the frozen particles produced by the frozen particle producing means by adjusting the temperature in the frozen particle producing chamber at which the frozen particles are formed comprising a flow control valve disposed between the coolant supply nozzle and a coolant source for adjusting the amount of coolant sprayed from the coolant supply nozzle into the frozen particle producing chamber, thereby controlling the temperature at which the frozen particles are formed; and means for ejecting the frozen particles towards an article for polishing the article.

2. A polishing apparatus as claimed in claim 1 wherein the frozen particle producing means comprises a frozen particle supply pipe connected with the freezing vessel and the means for ejecting frozen particles for conveying the frozen particles from the freezing vessel to the means for ejecting.

3. A polishing apparatus as claimed in claim 1 comprising a temperature sensor disposed in the frozen particle producing chamber for monitoring the temperature of the freezing atmosphere.

* * * * *